US010389046B2

(12) United States Patent
Chastain et al.

(10) Patent No.: US 10,389,046 B2
(45) Date of Patent: Aug. 20, 2019

(54) COAXIAL CONNECTOR WITH GROMMET BIASING FOR ENHANCED CONTINUITY

(71) Applicant: PERFECTVISION MANUFACTURING, INC., Little Rock, AR (US)

(72) Inventors: Robert J. Chastain, Maumelle, AR (US); Glen David Shaw, Conway, AR (US); David A. Kelly, Arkadelphia, AR (US); Linan Gan, Foshan (CN)

(73) Assignee: PERFECTVISION MANUFACTURING, INC., Little Rock, AR (US)

( * ) Notice: Subject to any disclaimer, the term of this patent is extended or adjusted under 35 U.S.C. 154(b) by 0 days.

(21) Appl. No.: 15/975,689

(22) Filed: May 9, 2018

(65) Prior Publication Data

US 2018/0269605 A1 Sep. 20, 2018

Related U.S. Application Data

(63) Continuation of application No. 14/456,659, filed on Aug. 11, 2014, now Pat. No. 9,997,847, which is a continuation of application No. 13/644,436, filed on Oct. 4, 2012, now abandoned, which is a continuation-in-part of application No. 13/374,378, filed on Dec. 27, 2011, now Pat. No. 8,636,541.

(51) Int. Cl.

| | |
|---|---|
| ***H01R 9/05*** | (2006.01) |
| ***H01R 13/52*** | (2006.01) |
| ***H01R 13/652*** | (2006.01) |

(52) U.S. Cl.
CPC ..... *H01R 9/0521* (2013.01); *H01R 13/5202* (2013.01); *H01R 13/652* (2013.01)

(58) Field of Classification Search
CPC ..... H01R 9/0521
See application file for complete search history.

(56) References Cited

U.S. PATENT DOCUMENTS

| | | | |
|---|---|---|---|
| 3,678,445 | A | 7/1972 | Brancaleone |
| 3,739,076 | A | 6/1973 | Schwartz |
| 3,835,442 | A | 9/1974 | Anderson et al. |
| 4,106,839 | A | 8/1978 | Cooper |
| 4,330,166 | A | 5/1982 | Cooper et al. |
| 4,423,919 | A | 1/1984 | Hillis |
| 5,066,248 | A | 11/1991 | Gaver, Jr. et al. |
| 5,984,602 | A | 11/1999 | Park |
| 6,332,815 | B1 | 12/2001 | Bruce |
| 6,406,330 | B2 | 6/2002 | Bruce |
| 6,716,062 | B1 | 4/2004 | Palinkas et al. |
| 7,114,990 | B2 | 10/2006 | Bence et al. |
| 7,753,705 | B2 | 7/2010 | Montena |
| 7,824,216 | B2 | 11/2010 | Purdy |
| 7,841,896 | B2 | 11/2010 | Shaw et al. |
| 7,892,005 | B2 | 2/2011 | Haube |
| 7,945,976 | B2 | 5/2011 | Rice |
| 7,982,024 | B2 | 7/2011 | Cohen et al. |
| 2013/0164975 | A1 | 6/2013 | Blake et al. |
| 2013/0171869 | A1 | 7/2013 | Chastain et al. |
| 2013/0237089 | A1 | 9/2013 | Lu |

*Primary Examiner* — Ross N Gushi
(74) *Attorney, Agent, or Firm* — Paul D. Chancellor; Ocean Law

(57) ABSTRACT

A compressible F-connector and method for interconnection with coaxial cable that includes a biasing member for promoting electrical continuity.

15 Claims, 10 Drawing Sheets

COAXIAL CONNECTOR WITH GROMMET BIASING FOR ENHANCED CONTINUITY

PRIORITY APPLICATIONS

This patent is a 1) continuation of U.S. patent application Ser. No. 14/456,659 filed Aug. 11, 2014 which is 2) a continuation of U.S. patent application Ser. No. 13/644,436 filed Oct. 4, 2012, entitled "Coaxial Connector With Grommet Biasing For Enhanced Continuity" now abandoned which is 3) a continuation-in-part of U.S. patent application Ser. No. 13/374,378, filed Dec. 27, 2011, now U.S. Pat. No. 8,636,541, entitled "Enhanced Coaxial Connector Continuity."

BACKGROUND OF THE INVENTION

1. Field of the Invention

The present invention relates generally to coaxial cable connectors. More particularly, the present invention relates to coaxial F-connectors adapted to insure the establishment of a proper ground during installation. Known prior art is classified in United States Patent Class 439, Subclasses 241, 247, 322, 548, 553, 554, 585, and 587.

2. Description of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of receptacles, such as a port, forming the "female" portion of the connection.

F-connectors include a tubular post designed to slide over coaxial cable dielectric material and under the braided outer conductor at the prepared end of the coaxial cable. The exposed, conductive braid is usually folded back over the cable jacket. The cable jacket and folded-back outer conductor extend generally around the outside of the tubular post and are typically coaxially received within the tubular connector. A continuity contact between the outer conductor and the connector is needed. Moreover, contact must be made with the threaded head or nut of the connector that should contact the female port to which the connection is made.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection and no separate part is needed. A wide variety of F-connectors are known in the art, including the popular compression type connector that aids in rapid assembly and installation. Hundreds of such connectors are seen in U.S. Patent Class 439, particularly Subclass 548.

The extremely high bandwidths and frequencies distributed in conjunction with modern satellite installations necessitate a variety of strict quality control factors. For example, the electrical connection established by the F-connector must not add electrical resistance to the circuit. It must exhibit a proper impedance match to maintain a wide bandwidth, in the order of several Gigahertz. Numerous physical design requirements exist as well. For example, connectors must maintain a proper seal against the environment, and they must function over long time periods through extreme weather and temperature conditions. Requirements exist governing cable insertion and retention forces as well.

Importantly, since a variety of coaxial cable diameters exist, it is imperative that satisfactory F-connectors function with different types of cable, such as dual-shield, tri-shield, and quad-shield coaxial cables that are found in the satellite television and cable television art.

It is important to establish an effective electrical connection between the F-connector, the internal coaxial cable, and the terminal port. One facet of the problem involves electrical continuity that must be established between the connector nut and the usually-barbed post within the connector. More particularly, it is important to establish a dependable electrical connection between the nut, the post, and the coaxial cable outer conductor.

Proper installation techniques require adequate torqueing of the connector head. In other words, it is desired that the installer appropriately tighten the connector during installation. A dependable electrical grounding path must be established from the port through the connector to the outer conductor of the coaxial cable. Threaded F-connector nuts should be installed with a wrench to establish reasonable torque settings. Critical tightening of the F-connector nut to the threaded port applies enough pressure to the internal components of the typical connector to establish a proper electrical ground path. When fully tightened, the head of the tubular post of the connector directly engages the edge of the outer conductor of the port, thereby making a direct electrical ground connection between the outer conductor of the port and the tubular post; in tum, the tubular post is engaged with the outer conductor of the coaxial cable.

Many connector installations, however, are not properly completed. It is a simple fact in the satellite and cable television industries that many F-connectors are not appropriately tightened by the installer. A typical recommended installation technique is to torque the F-connector with a small wrench during installation. In some cases installers only partially tighten the F-connector. Some installations are only hand-tightened. As a consequence, proper electrical continuity may not be achieved. Such F-connectors will not be properly "grounded," and the electrical grounding path can be compromised and intermittent. An appropriate low resistance, low loss connection to the target port, and the equipment connected to it, will not be established. Unless a proper ground path is established, poor signal quality and RFI leakage will result. This translates to degradation of video signal quality.

U.S. Pat. No. 3,678,445 issued Jul. 18, 1972 discloses a shield for eliminating electromagnetic interference in an electrical connector. A conductive shielding member having a spring portion snaps into a groove for removably securing the shield. A second spring portion is yieldable to provide electrical contact between the first shell member and a second movable shell member.

U.S. Pat. No. 3,835,442 issued Sep. 10, 1974 discloses an electromagnetic interference shield for an electrical connector comprising a helically coiled conductive spring interposed between mating halves of the connector. The coiled spring has convolutions slanted at an oblique angle to the center axis of the connector. Mating of the connector members axially flattens the spring to form an almost continuous metal shield between the connector members.

U.S. Pat. No. 3,739,076 issued Jun. 12, 1973 discloses a coaxial connector with an internal, electrically conductive coil spring mounted between adjacent portions of the connector. As an end member is rotatably threaded toward the housing, an inwardly directed annular bevel engages the spring and moves it inwardly toward an electrically shielded portion of the cable. The spring is compressed circumferentially so that its inner periphery makes electrical grounding contact with the shielded portion of the cable.

U.S. Pat. No. 5,066,248 issued Nov. 19, 1991 discloses a coaxial cable connector comprising a housing sleeve, a connector body, a locking ring, and a center post. A stepped annular collar on the connector body ensures metal-to-metal contact and grounding.

U.S. Pat. No. 4,106,839 issued Aug. 15, 1978 shows a coaxial connector with a resilient, annular insert between abutting connector pieces for grounding adjacent parts. A band having a cylindrical surface is seated against an internal surface. Folded, resilient projections connected with the band are biased into contact. The shield has tabs for mounting, and a plurality of folded integral, resilient projections for establishing a ground.

U.S. Pat. No. 4,423,919 issued Jan. 3, 1984 discloses a connector having a cylindrical shell with a radial flange, a longitudinal key, and a shielding ring fitted over the shell and adjacent to the flange. The shielding ring comprises a detent having end faces configured to abut connector portions when the detent fits within the keyway, whereby the shell is prevented from rotating.

U.S. Pat. No. 4,330,166 issued May 18, 1982 discloses an electrical connector substantially shielded against EMP and EMI energy with an internal, conductive spring washer seated in the plug portion of the connector. A wave washer made from beryllium copper alloy is preferred.

U.S. Pat. No. 6,406,330 issued Jun. 18, 2002 employs an internal, beryllium copper clip ring for grounding. The clip ring forms a ground circuit between a male member and a female member of the electrical connector. The clip ring includes an annular body having an inner wall and an outer wall comprising a plurality of circumferentially spaced slots.

U.S. Pat. No. 7,114,990 issued Oct. 3, 2006 discloses a coaxial cable connector with an internal grounding clip establishing a grounding path between an internal tubular post and the connector. The grounding clip comprises a C-shaped metal clip with an arcuate curvature that is non-circular.

U.S. Pat. No. 7,479,035 issued Jan. 20, 2009 shows a similar F-connector grounding arrangement.

U.S. Pat. No. 7,753,705 issued Jul. 13, 2010 discloses an RF seal for coaxial connectors that makes a uniform RF seal. The seal comprises a flexible brim, a transition band, and a tubular insert with an insert chamber defined within the seal. In a first embodiment the flexible brim is angled away from the insert chamber, and in a second embodiment the flexible brim is angled inward toward the insert chamber. A flange end of the seal makes a compliant contact between the port and connector faces when the nut of a connector is partially tightened, and becomes sandwiched firmly between the ground surfaces when the nut is properly tightened.

U.S. Pat. No. 7,892,024 issued Feb. 22, 2011 shows a similar grounding insert for F-connectors.

U.S. Pat. No. 7,824,216 issued Nov. 2, 2010 discloses a coaxial connector comprising a body, a post including a flange having a tapered surface, a nut having an internal lip with a tapered surface which oppositely corresponds to the tapered surface of the post when assembled, and a conductive 0-ring between the post and the nut for grounding or continuity.

Similar U.S. Pat. No. 7,845,976 issued Dec. 7, 2010 and U.S. Pat. No. 7,892,005 issued Feb. 22, 2011 use conductive, internal 0-rings for both grounding and sealing.

U.S. Pat. No. 6,332,815 issued Dec. 25, 2001 and U.S. Pat. No. 6,406,330 issued Jun. 18, 2002 utilize clip rings made of resilient, conductive material such as beryllium copper for grounding. The clip ring forms a ground between a male member and a female member of the connector.

U.S. Pat. No. 6,716,062 issued Apr. 6, 2004 discloses a coaxial cable F connector with an internal coiled spring that establishes continuity. The spring biases the nut toward a rest position wherein not more than three revolutions of the nut are necessary to bring the post of the connector into contact.

U.S. Pat. No. 7,841,896 issued Nov. 30, 2010, and entitled "Sealed compression type coaxial cable F-connectors", which is owned by the instant assignee, discloses axially compressible, high bandwidth F-connectors for interconnection with coaxial cable. An internal, dual segment sealing grommet activated by compression provides a seal. Each connector nut interacts with a tubular body and a rigid, conductive post coaxially extending through the connector. A post barbed end penetrates the cable within the connector. A metallic end cap is slidably fitted to the body. A tactile system comprising external convex projections on the body complemented by a resilient, external O-ring on the end cap aids installers to properly position connectors with the sense of touch.

For an adequate design, structural improvements to compressible F-connectors for improving continuity or grounding must function reliably without degrading other important connector requirements. Compressible connectors must adequately compress during installation without excessive force. An environmental seal must be established to resist penetration of moisture. The coaxial cable inserted into the connector must not be mechanically broken or short circuited during installation. Field installers and technicians must be satisfied with the ease of installation. Finally, the bottom line is that a reliable installation must result for customer satisfaction.

As implied from the above-discussed art, many prior art attempts at enhanced grounding exist. Several solutions involve the addition of a conductive grounding member within the fitting that physically and electrically bears against critical parts to enhance continuity. However, it is becoming increasingly clear to us that an alternative solution for the above discussed continuity problem is to modify internal connector parts to specifically pressure critical parts together to force electrical contact. In other words, we have provided an internal pressure-generating connector that enhances continuity without the addition of separate conductive, electrical grounding apparatus such as inserts, rings, bridges or other apparatus.

BRIEF SUMMARY OF THE INVENTION

The compressible type coaxial connector described herein comprises a rigid nut with a faceted drive head adapted to be torqued during installation of a fitting. The head has an internally threaded, axial bore, for threadably mating with a typical port. An elongated, internal post coupled to the nut includes a shank, which can be barbed, that engages the prepared end of a coaxial cable. A hollow tubular body is coupled to the post. When the device is assembled, an end cap is press fitted to the body, coaxially engaging the body, and completing the assembly. Internal O-rings, band seals, or the like may be combined for sealing the connector.

In known F-connector designs the internal post establishes electrical contact between the coaxial cable outer conductor and metallic parts of the coaxial fitting, such as the nut. Also, the elongated, tubular shank extends from the post flange to engage the coaxial cable, making contact with the metallic, insulative outer conductor.

However, since improper or insufficient tightening of the nut during F-connector installation is so common, and since continuity and/or electrical grounding suffer as a result, our designs utilize adaptations to the tubular body to mechanically pressure the nut, once the connector is assembled. Body-applied pressures establish a dependable grounding path between the nut and the internal post.

The connector described utilizes a specially configured grommet fitted to an annular ring within the body for encouraging electrical contact between the nut, the post and thus the outer conductor of the coaxial cable to which the fitting is fastened. The grommet urges against and physically contacts the nut once the connector is assembled.

The preferred grommet comprises a short band of resilient material, preferably plastic. The band-like body resembles a short cylinder, but a plurality of spaced-apart projections are radially spaced apart around the band. These integral projections are preferably circular. When the band is received within the annular groove of the body, the projections extend outward from the body end. In other words, a plurality of substantially hemispherical projections that are offset from the body physically contact the nut, and pressure it against the post.

Resultant pressure from the projections promotes continuity between the post and nut. Electrical contact between the post, the nut, and the coaxial cable is thus insured, despite insufficient tightening of the nut.

Thus the primary object of our invention is to promote electrical continuity within an F-connector to overcome electrical connection problems associated with improper installation.

More particularly, an object of our invention is to provide dependable electrical connections between coaxial connectors, especially F-connectors, and female connectors or sockets.

Another object of the present invention is to provide internal structure for promoting grounding contact between the post and nut within improperly-tightened coaxial cable connectors.

A similar object is to provide a proper continuity in a coaxial connector, even though required torque settings have been ignored.

Another object of the present invention is to provide reliable continuity between a connector and a target port, even if the connector is not fully tightened.

It is another object of the present invention to provide a compressible coaxial cable connector which establishes and maintains reliable electrical continuity.

It is still another object of the present invention to provide such a coaxial connector that can be manufactured economically.

Another object of our invention is to provide a connector of the character described that establishes satisfactory EMP, EMI, and RFI shielding.

A related object is to provide a connector of the character described that establishes reliable continuity between critical parts during installation of the male connector to the various types of threaded female connections, even though applied torque may fail to meet specifications.

Another essential object is to establish a proper ground electrical path with a port even where the male connector is not fully torqued to the proper settings.

Another important object is to minimize resistive losses in a coaxial cable junction.

A still further object is to provide a connector of the character described suitable for use with demanding large, bandwidth systems approximating three GHz.

A related object is to provide an F-connector ideally adapted for home satellite systems distributing multiple, high definition television channels.

Another important object is to provide a connector of the character described that is weather proof and moisture resistant.

Another important object is to provide a compression F-connector of the character described that can be safely and properly installed without deformation of critical parts during final compression.

A related object is to maintain proper impedance matching of the connector across the bandwidth approximating from DC up to three GHz even when not properly tightened.

These and other objects and advantages of the present invention, along with features of novelty appurtenant thereto, will appear or become apparent in the course of the following descriptive sections.

BRIEF DESCRIPTION OF THE DRAWINGS

The following drawings show illustrative embodiments of the invention.

DETAILED DESCRIPTION OF ILLUSTRATIVE EMBODIMENTS

Figure 1:
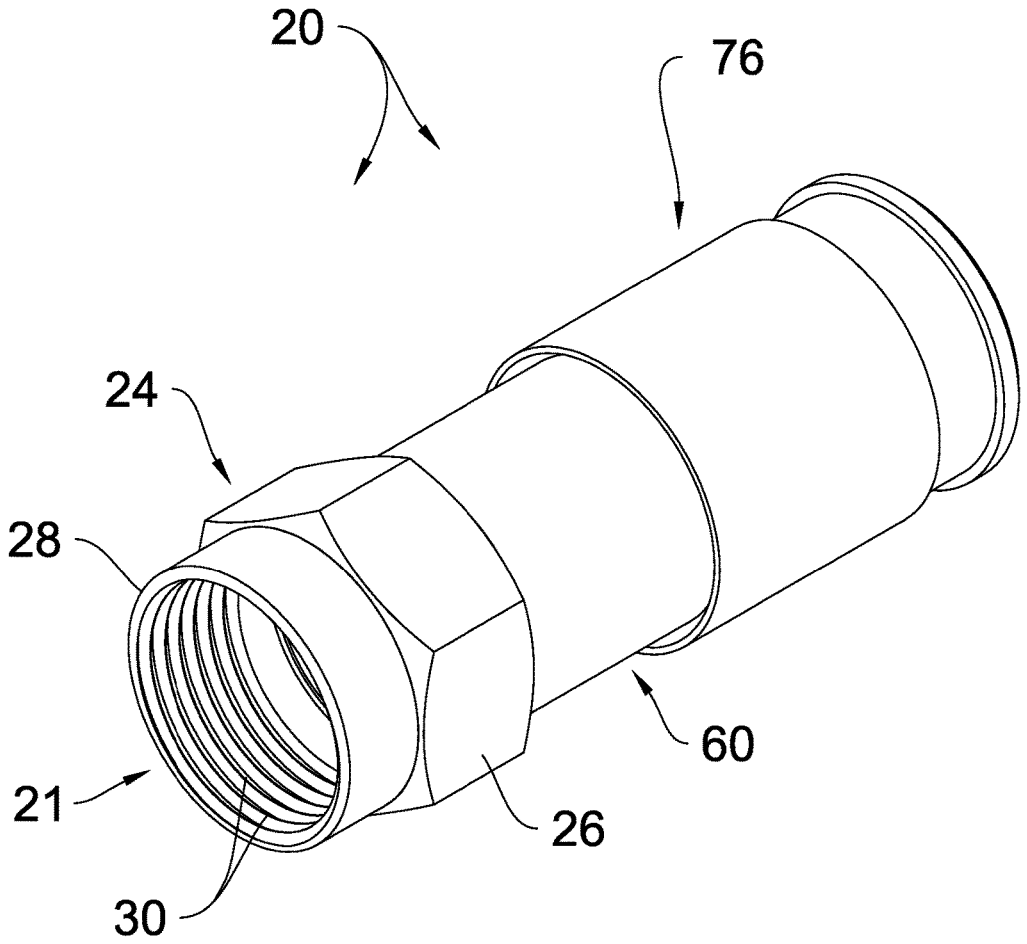
FIG. 1 is a frontal isometric view of a first embodiment of a coaxial connector in which the adaptations of our invention are incorporated.
Figure 2:
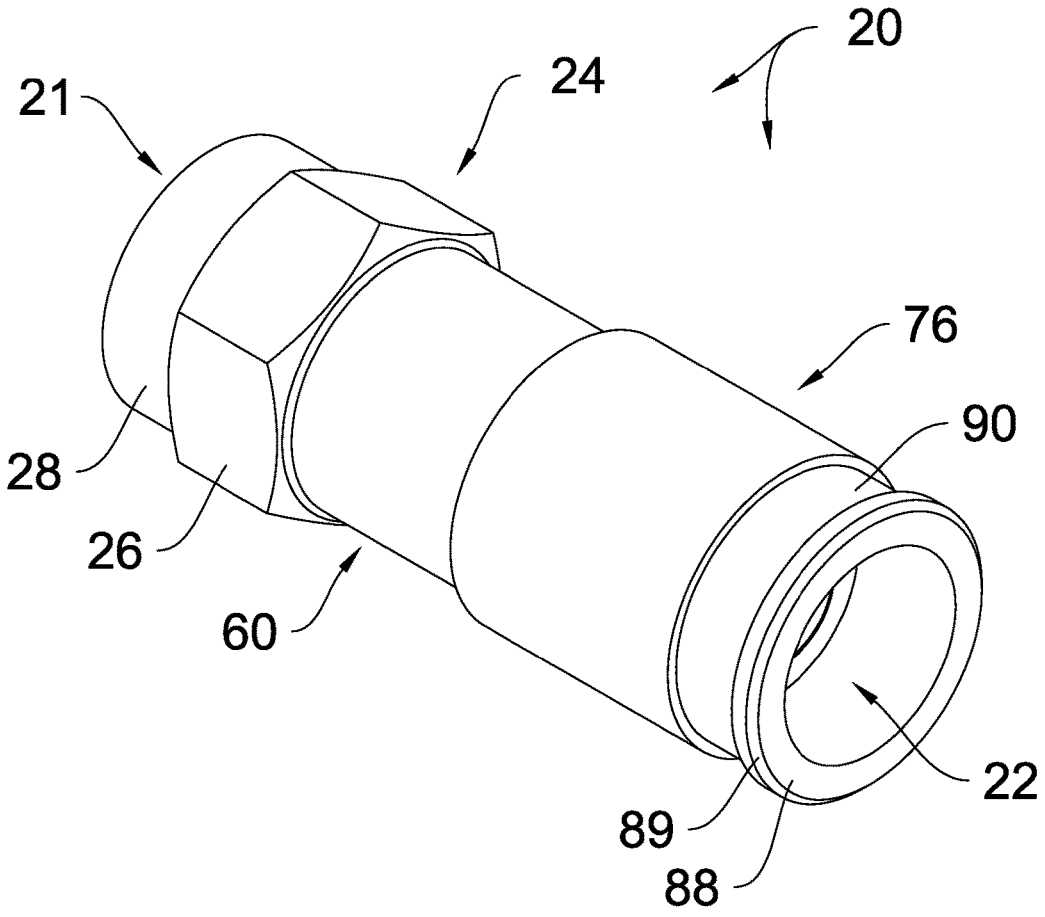
FIG. 2 is a rear isometric view of the connector.

Coaxial cable F-connectors are well known in the art. The basic constituents of the compressible coaxial connector of FIGS. 1 and 2 are described in detail, for example, in prior U.S. Pat. No. 7,841,896 entitled "Sealed compression type coaxial cable F-connectors", issued Nov. 30, 2010, and in prior U.S. Pat. No. 7,513,795, entitled "Compression type coaxial cable F-connectors", issued Apr. 7, 2009, which are both owned by the same assignee as in the instant case, and which are both hereby incorporated by reference for purposes of disclosure as if fully set forth herein. However, it will be appreciated by those with skill in the art that coaxial cable connectors of other designs may be employed with the grounding adaptations described hereinafter.

Referring initially to FIGS. 1-4 of the appended drawings, a coaxial F-connector has been generally designated by the reference numeral 20. As will be recognized by those skilled in the art, connector 20 is a compressible F-connector that is axially squeezed together longitudinally when secured to a coaxial cable. As is also recognized in the art, connector 20 is adapted to terminate an end of a properly prepared coaxial cable, which is properly inserted through the open bottom end 22 (FIG. 2) of the connector 20. Afterwards, the connector 20 is placed within a suitable compression hand tool for compression.

Figure 3:
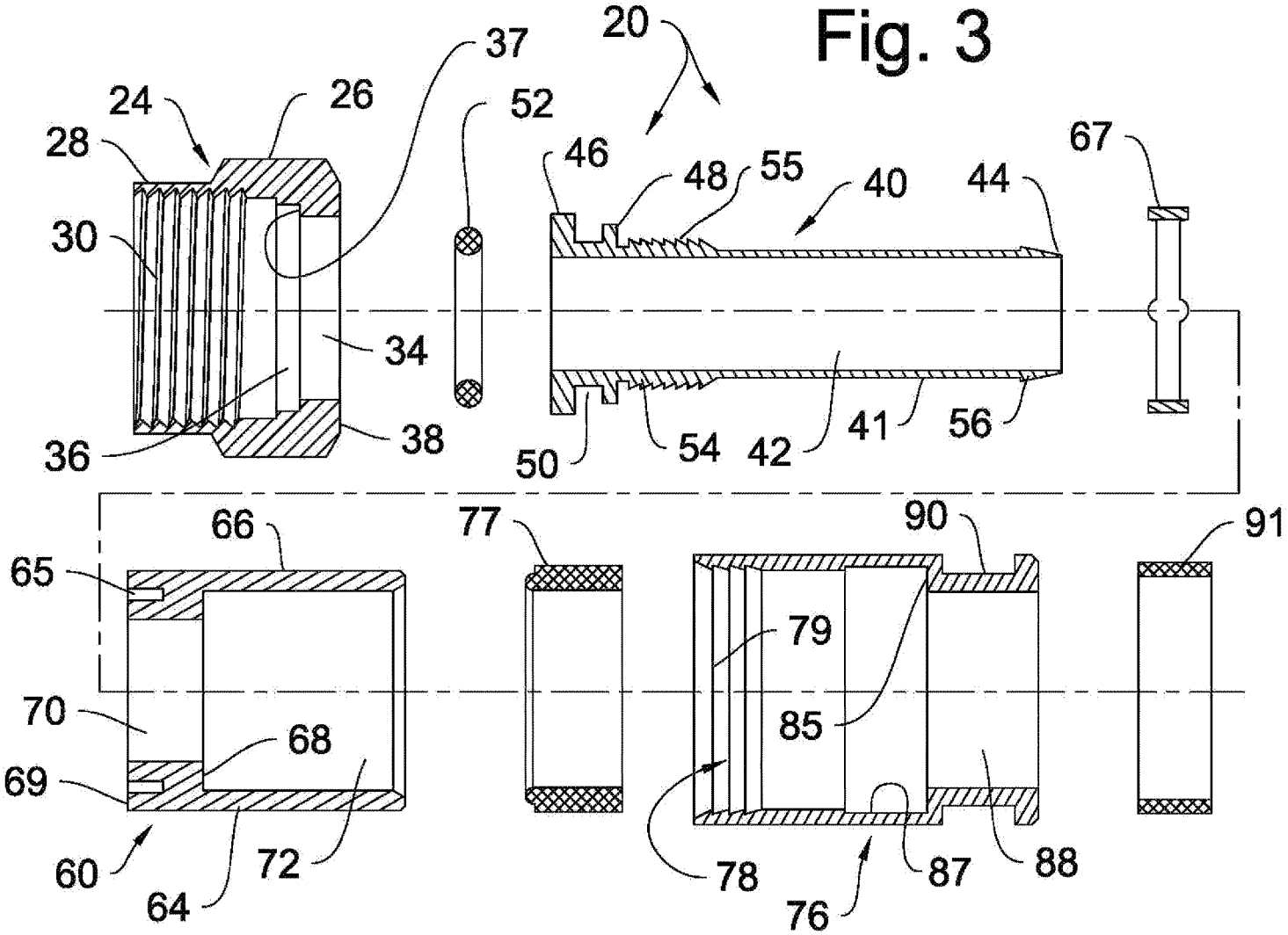
FIG. 3 is an exploded, longitudinal sectional view of the connector.

Connector 20 comprises a rigid, metallic nut 24 with a conventional faceted, preferably hexagonal drive head 26 integral with a protruding, tubular stem 28. Nut 24 is torqued during installation. Conventional, internal threads 30 are defined in the stem interior for rotatably, threadably mating with a suitably-threaded socket. The open, tubular front end 21 connects through the open interior to a reduced diameter, rear passageway 34 at the back of nut 24 (FIG. 3). Circular passageway 34 concentrically borders an annular, non-threaded, internal ring groove 36 that borders an internal shoulder 37 proximate passageway 34. There is an annular wall 38 at the rear of the nut 24.

In assembly the elongated post 40 rotatably, coaxially passes through the hex headed nut 24 and establishes electrical contact between the outer conductor of the coaxial cable end (not shown) and the metallic nut 24. The tubular post 40 defines an elongated shank 41 with a coaxial, internal passageway 42 extending between its front 43 (FIG. 4) and rear 44. Shank 41 may or may not have barbs 56 formed on it at the rear 44 for engaging coaxial cable. An integral front flange 46 (FIG. 3) borders a spaced-apart, reduced diameter secondary flange 48. A circumferential groove 50 is located between flanges 46 and 48 to seat an O-ring 52 for sealing. Preferably the post 40 has a barbed, collar 54 comprising multiple, external barbs 55 that firmly engage the body 60 in assembly as described below. Body 60 may include a radial gap 695 between a body overhang 697 and a body collar 699. In assembly it is noted that post flange 46 (i.e., FIGS. 3, 4) axially contacts inner shoulder 37 (FIG. 3) within nut 24, and electrical contact between these parts is established.

With installation, the rear, tapered end 44 of post shank 41 penetrates the prepared end of the coaxial cable, such that the inner, insulated center conductor coaxially penetrates passageway 42 and enters the front end 21 of the nut 24. As recognized by those skilled in the art, the outer conductor of the coaxial cable prepared end will be substantially positioned around the exterior of post shank 41 when the connector is compressed. Electrical contact or continuity between the coaxial cable outer conductor, the post 40, and the nut 24 must be established in use. To enhance the likelihood of establishing reliable continuity in embodiments of our invention, the connector body has been designed to firmly engage the post 40 and to pressure the nut 24 against the post 40 when the connector is assembled, even when the nut 24 has not been properly tightened on the female port.

An elongated, hollow, tubular body 60, normally molded from plastic, is coupled to the post 40. Body 60 comprises an elongated shank 64, preferably of a uniform diameter. The elongated, outer periphery 66 of body shank 64 is preferably smooth and cylindrical. Body 60 comprises an internal passageway 70 at the body front that communicates with larger diameter, passageway 72 extending from internal shoulder 68 to the body rear (FIG. 3). In assembly, (FIG. 4) the post 40 will coaxially penetrate passageways 70 and 72. In assembly, the barbed post collar 54 is frictionally seated within body passageway 70. As explained below, body 60 is especially adapted to mechanically pressure the nut 24 and post 40 together upon assembly to promote continuity. To this effect there is an annular groove 65 defined in the annular front surface 69 (i.e., FIG. 4) of the body 60 that receives and seats a specially configured grommet 67 described in detail hereinafter.

In assembly, an end cap 76 is pressed unto body 60 with a suitable hand-tool, coaxially engaging the body shank 64. The rigid, preferably metallic end cap 76 smoothly, frictionally grips the body shank 64. Preferably, end 78 of the end cap 76 includes internally barbed region 79 that couples to the shank 64 of the body 60. When the body 60 and the end cap 76 are compressed together, a friction fit is achieved. The reduced diameter passageway 88 is sized to receive coaxial cable.

An outer ring groove 90 at the cap rear can seat an optional external band 91 that can be added to establish a tactile "feel" for the installer. Band 91 can also enhance the aesthetic appearance of the connector, and it can facilitate color coding. Preferably, there is a dual diameter seal 77 seated against shoulder 85 within a ring groove 87 within end cap 76. Seal 77 is explained in detail in U.S. Pat. No. 7,841,896 issued to Shaw , et al. on Nov. 30, 2010, entitled "Sealed Compression type Coaxial Cable F-Connectors", which is hereby incorporated by reference for purposes of disclosure as if fully set forth herein.

Grounding or continuity is established in part by mechanical and electrical contact between internal nut shoulder 37 (FIG. 3) and post flange 46. The coaxial cable outer conductor bearing against the post shank 41 would thus electrically interconnect the cable ground to the post 40. Mechanical contact between the post flange 46 and the nut shoulder 37 in tum establishes electrical contact between the post 40 and the nut 24. Mechanical contact between the nut internal threads 30 and external threads of the port to which nut 24 is attached electrically interconnects the nut to the port, completing the electrical circuit from the cable to the port. However, grounding or continuity generally depends on proper tightening of the nut 24 to ensure sufficient mechanical contact between the post flange 46 and the nut shoulder 37. In the real world, installers often neglect to properly tighten the nut 24, so less internal, mechanical pressure is available within the F-connector to urge the parts discussed above into mechanically abutting, electrically conductive contact. Accordingly, each connector described herein includes a body 60 that has been adapted to encourage mechanical contact between nut 24 and post 40 for maintaining continuity.

Figure 4:
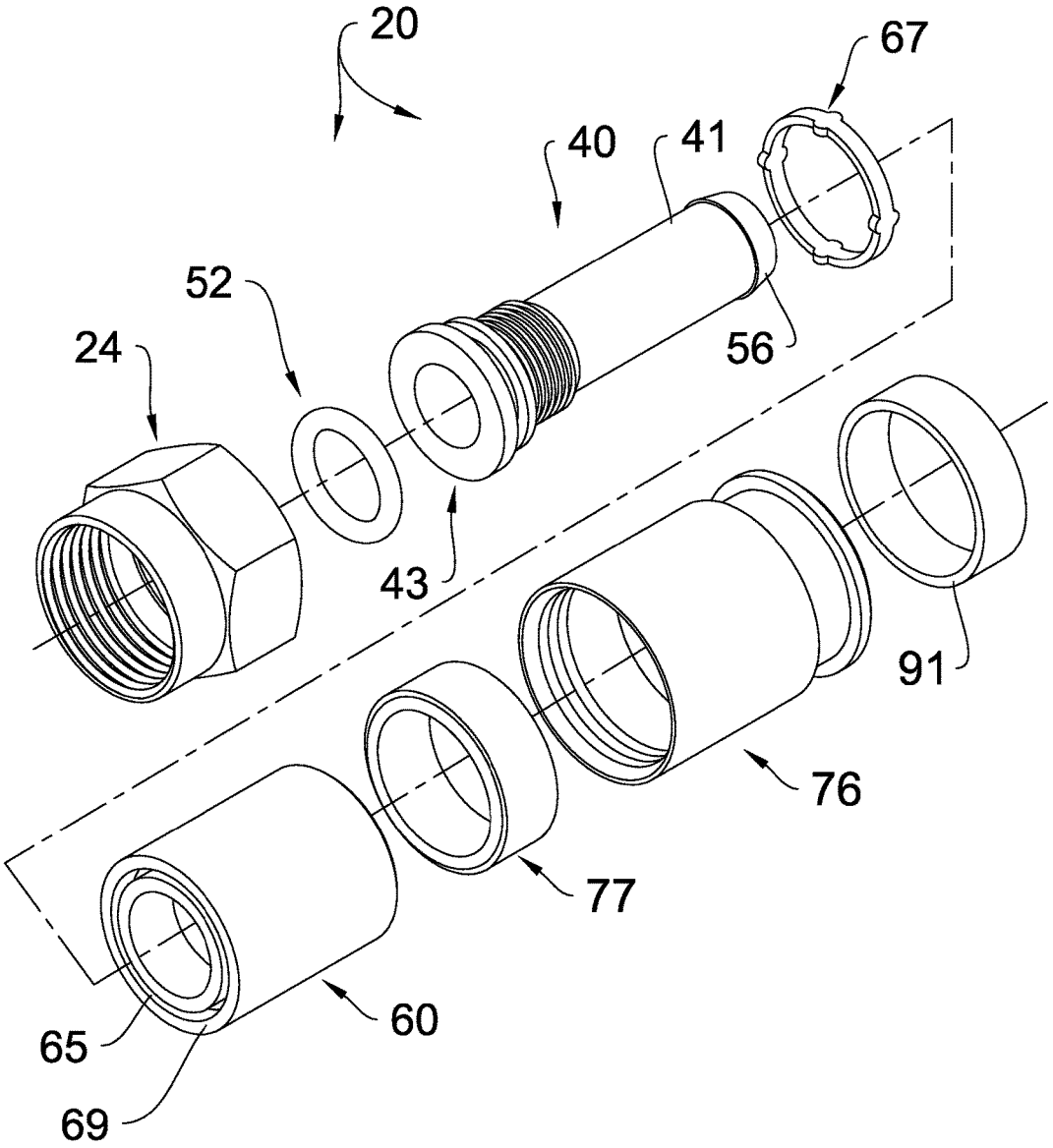
FIG. 4 is an exploded, isometric assembly view of the connector.
Figure 5:
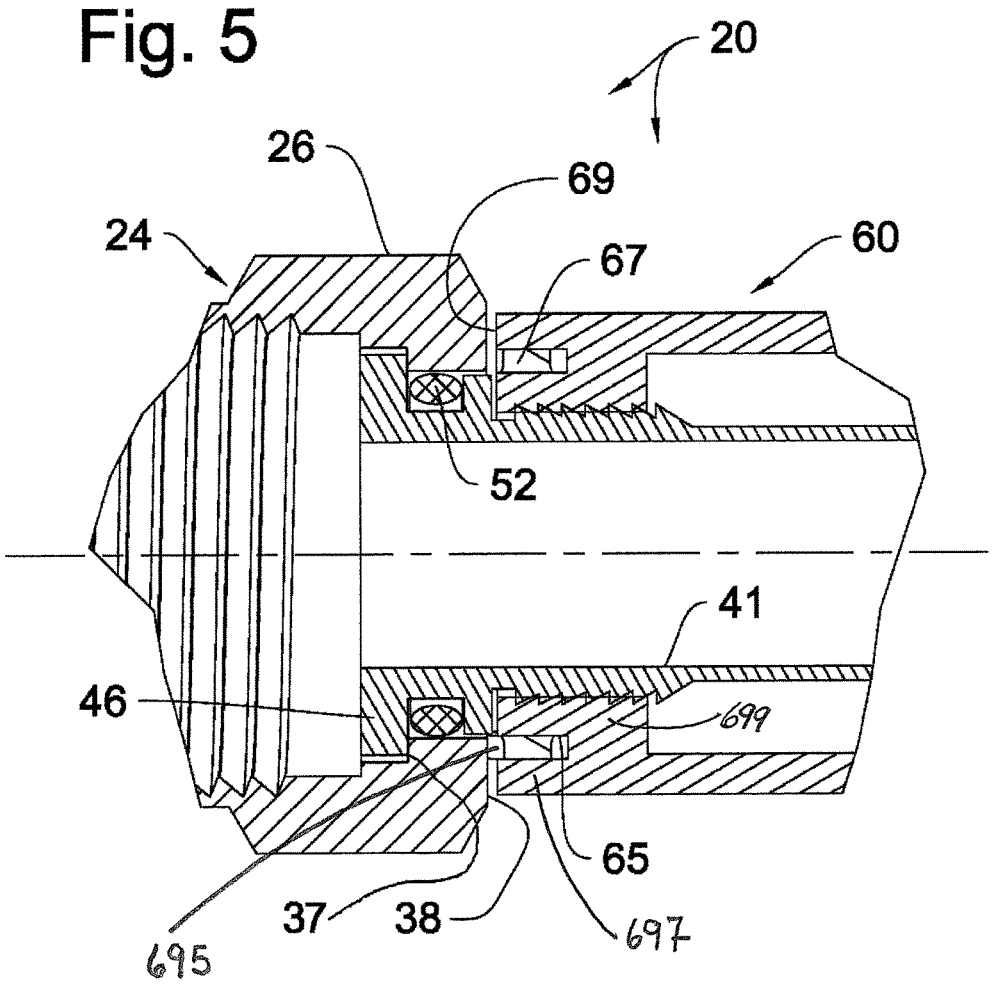
FIG. 5 is an enlarged, fragmentary sectional view showing the preferred biasing grommet within the body.

In FIGS. 3-5 it will be noted that an annular groove 65 is coaxially defined within the front of the body 60. In assembly, a biasing grommet 67 is inserted within the groove 65. When the connector 20 is compressed during assembly, the body will be frictionally moved towards the nut 24. As best viewed in FIG. 5, portions of the grommet 67 seated within groove 65 will thus be forced against the nut, bearing against nut annular wall 38. As grommet 67 pressures the nut, flange 46 of the post 40 will be physically contacted by the inner shoulder 37 of the nut. A proper ground and connector continuity are thus encouraged by the physical pressure applied by the body 60 and grommet 67.

With joint reference now directed to drawing FIGS. 6-13, in an embodiment the preferred grommet 67 comprises a circular band portion 100 that fits within the body groove 65. Band 100 is in the form of a very short cylinder. The thickness 102 (FIG. 8) of the band 100 is sized to snugly fit within groove 65. Band 100 has an annular front end 104 (i.e., FIGS. 6, 8) and a spaced apart, annular rear end 106 (i.e., FIGS. 7, 9). The length 108 (FIG. 10) of the grommet 67 is preferably greater than the thickness 102. In an embodiment the preferred length 108 of the grommet 67 is approximately two times the thickness 102.

It will be noted that in the embodiments shown in FIGS. 6-13 both ends of the grommet 67 are provided with a plurality of radially spaced apart projections. In the embodiment shown in FIG. 7 there are four, spaced apart projections 110 extending away from front end 104, and four similar projections 111 extending from rear grommet end 106 (i.e., FIG. 7). In certain embodiments, the number of projections on the front end 104 may differ from the projections on the rear end 106. Other embodiments exist with a plurality of radially spaced apart projections 110 emanating from only a single end, 104 or 106, of the grommet 67. All projections are integral with band 100. When the grommet 67 is disposed within body groove 65, the frontal projections 110 will extend outwardly from front, annular surface 69 of the body, contacting the nut 24. In embodiments of the invention having projections on both the front grommet end 104 and rear grommet end 106, it is preferred that projections 110 be aligned with projections 111, forming a unitary "bulge" at uniform, radially spaced part intervals around the circumference of band 100. Preferably each projection 110, 111 has a semi-circular profile, although other geometries can be employed.

For example, the alternative grommet 120 (FIG. 12) includes regularly spaced apart projections 122 and 123 that have a triangular profile.

Grommet 128 (FIG. 13) has projections 130, 132 that have a somewhat square profile.

Figure 6:
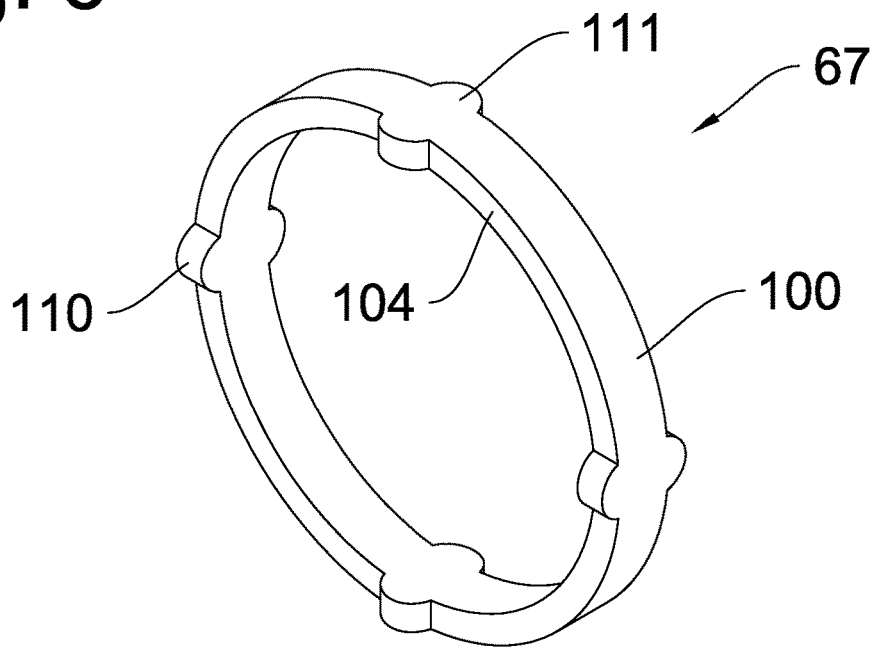
FIG. 6 is an enlarged, frontal isometric view of the preferred biasing grommet.
Figure 7:
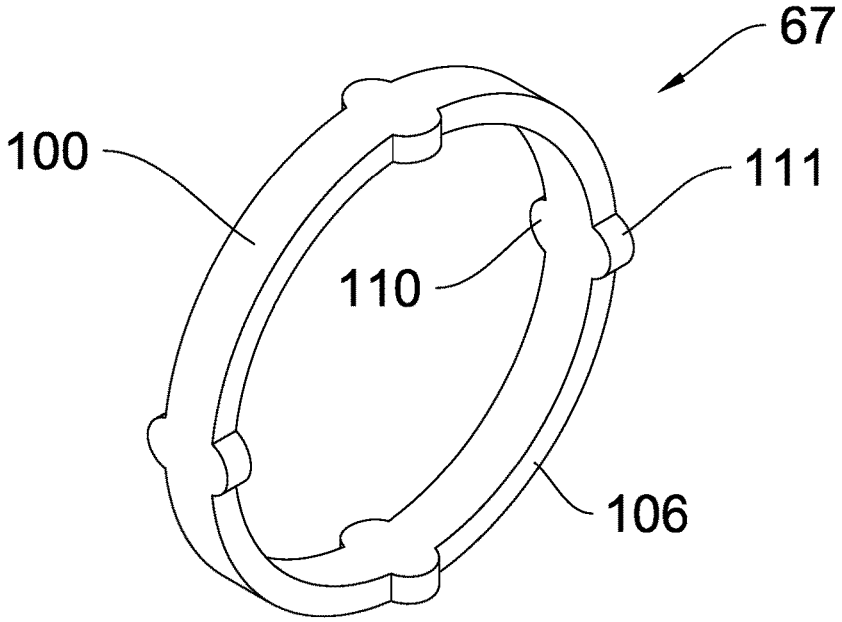
FIG. 7 is an enlarged, rear isometric view of the preferred biasing grommet.
Figure 8:
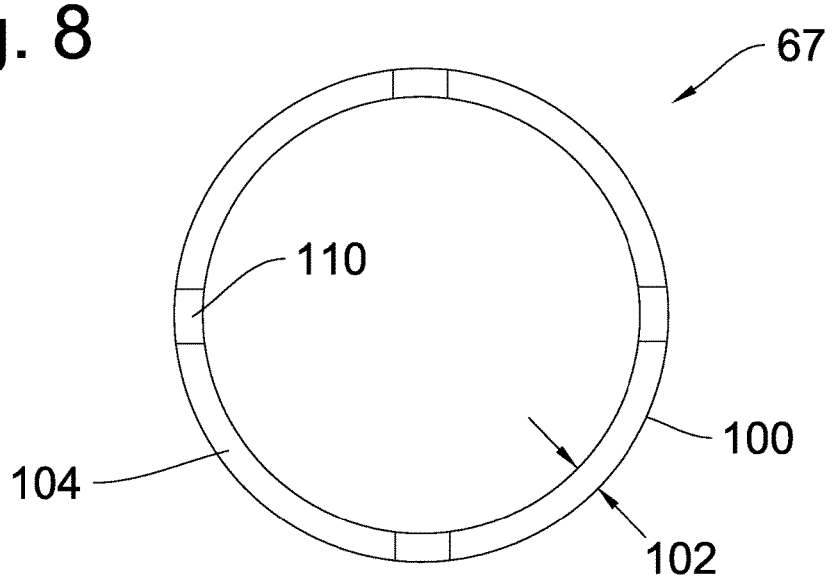
FIG. 8 is an enlarged, front plan view of the preferred biasing grommet.
Figure 9:
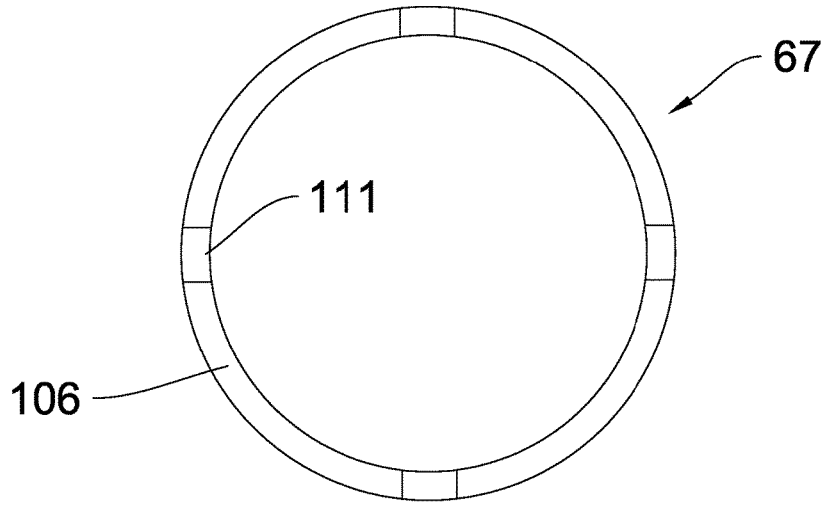
FIG. 9 is an enlarged, rear plan view of the preferred biasing grommet.
Figure 10:
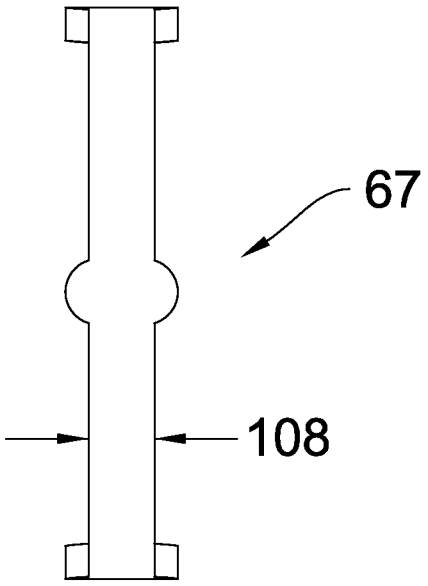
FIG. 10 is an enlarged, right side elevational view of the preferred biasing grommet.
Figure 11:
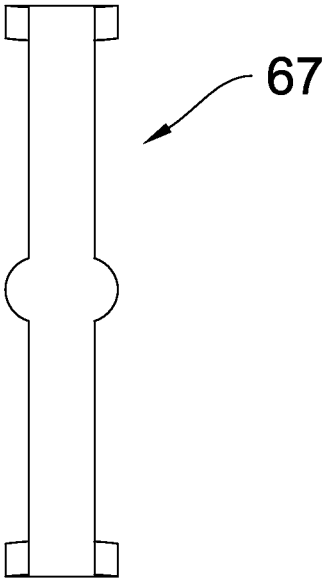
FIG. 11 is an enlarged, left side elevational view of the preferred biasing grommet; and, FIGS. 12-14 are frontal isometric views of alternative biasing grommets.
Figure 12:
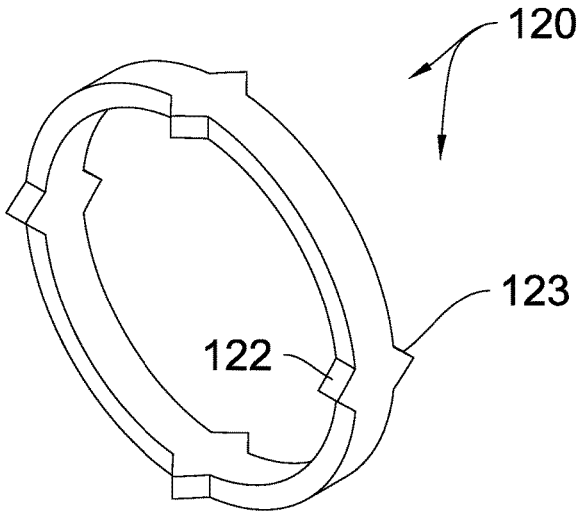
Figure 13:
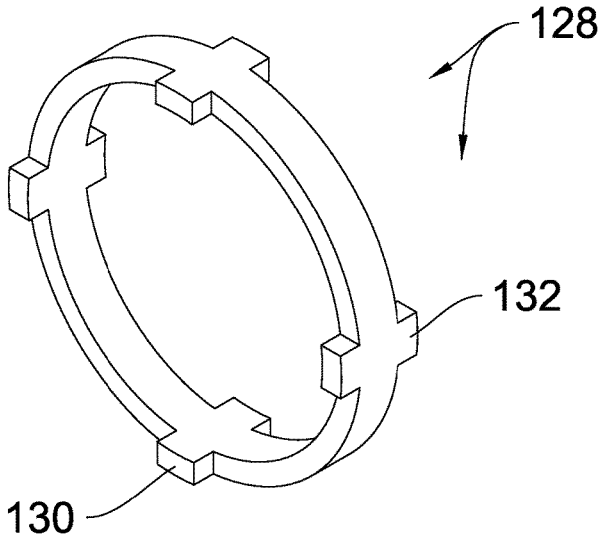
Figure 14:
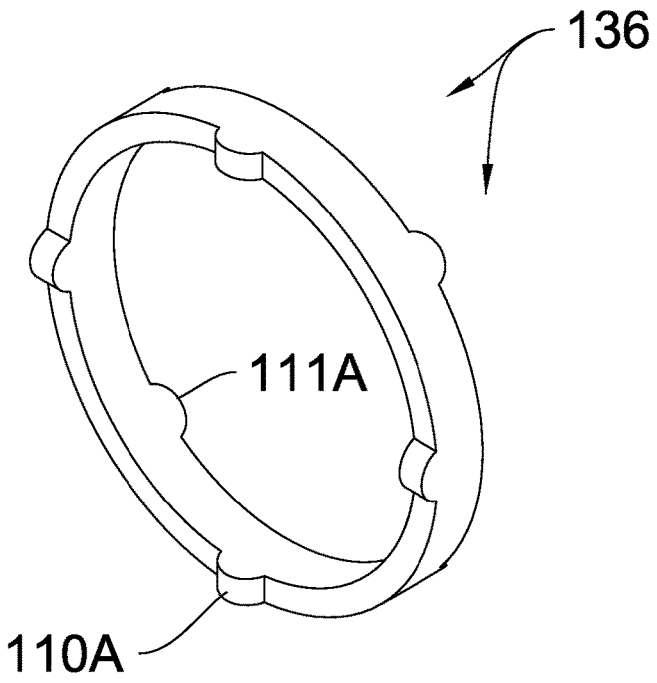

Finally, the grommet 136 seen in FIG. 14 has projections 110A and 111A similar to grommet 67 of FIG. 6, but the two series of integral projections are offset, or radially shifted from one another. In other words, the regularly spaced apart projections 111A on grommet 136 are shifted forty-five degrees about the circumference of the grommet, so they do not line up linearly with projections on the other end as in FIG. 6, but are instead offset radially in position.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compressible coaxial connector comprising:
a nut for fastening the connector to a mating part;
the nut for abutting a post inserted in a body;
a body annular groove facing the nut and a grommet protruding from the body annular groove;
the nut, post, and body in coaxial arrangement about a longitudinal axis of the connector; and,
wherein the nut is pushed into abutment with the post by action of the pusher.

2. The connector of claim 1 further including projections on the grommet for contacting the nut.

3. The connector of claim 2 further including projections on the grommet for contacting the body.

4. The connector of claim 3 wherein the projections for contacting the nut are pointed in a direction opposite the projections for contacting the body.

5. The connector of claim 4 wherein the projections for contacting the nut are between the projections for contacting the body.

6. A compressible coaxial connector comprising:
a nut for fastening the connector to a mating part;
a post inserted in a body; and,
a ring shaped grommet protruding from an annular body groove;
wherein connector configurations include a configuration where the grommet biases the nut into contact with a post flange.

7. The connector of claim 6 further including projections on the grommet for contacting the nut.

8. The connector of claim 7 further including projections on the grommet for contacting the body.

9. The connector of claim 8 wherein the projections for contacting the nut are pointed in a direction opposite the projections for contacting the body.

10. The connector of claim 9 wherein the projections for contacting the nut are between the projections for contacting the body.

11. In a coaxial connector, a nut and post engagement method including the steps of:
locating a post in a body such that a post flange is outside the body;
fixing the body to the post with a body collar;
separating the collar from a body overhang such that a radial gap exists therebetween; and,
biasing the nut against the post flange with a grommet inserted in the radial gap.

12. The engagement method of claim 11 further comprising the step of:
extending the body away from the collar such that the post projects from an end of the body.

13. The engagement method of claim 12 further comprising the step of:
enlarging an internal diameter of the body where the body extends away from the collar.

14. The engagement method of claim 13 further comprising the step of:
along the longitudinal axis, spacing the nut apart from the body.

15. The engagement method of claim 14 further comprising the step of:
sealing between the nut and the post with a seal in a circumferential post grove.

* * * * *